United States Patent [19]

Murata et al.

[11] Patent Number: 4,748,151

[45] Date of Patent: May 31, 1988

[54] HEAT TRANSFER RECORDING SHEET

[75] Inventors: Yukichi Murata, Sagamihara; Takao Hirota, Machida; Hiroshi Urabe, Kawasaki, all of Japan

[73] Assignee: Mitsubishi Chemical Industries Limited, Japan

[21] Appl. No.: 893,489

[22] Filed: Aug. 5, 1986

[30] Foreign Application Priority Data

Aug. 6, 1985 [JP] Japan ..... 60-172645
Oct. 14, 1985 [JP] Japan ..... 60-228394

[51] Int. Cl.[4] ..... B41M 5/26

[52] U.S. Cl. ..... 503/227; 8/471; 428/195; 428/412; 428/913; 428/914; 430/945

[58] Field of Search ..... 8/470, 471; 346/227; 427/146, 256; 428/195, 207, 411.1, 412, 913, 914; 430/945; 503/227

[56] References Cited

U.S. PATENT DOCUMENTS 4,541,830 9/1985 Hotta et al. ..... 8/471

FOREIGN PATENT DOCUMENTS 0229790 11/1985 Japan ..... 503/227

*Primary Examiner*—Bruce H. Hess
*Attorney, Agent, or Firm*—Jordan B. Bierman

[57] ABSTRACT

A heat transfer recording sheet is disclosed, comprising a base film having provided on one side thereof a coloring material layer containing at least a subliming dye and a binder, wherein said binder is a polycarbonate resin having a repeating unit represented by the formula (I):

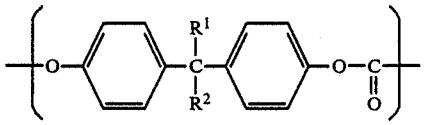

(I)

wherein $R^1$ represents an aryl group; and $R^2$ represents a hydrogen atom, an alkyl group or an aryl group. In another embodiment, said binder is a copolymer of polycarbonate resin having a repeating unit represented by the formula (I) and a repeating unit represented by the formula (II)

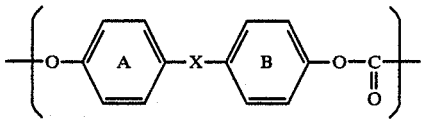

(II)

wherein rings A and B each represents a phenylene group or a phenylene group substituted with an alkyl group or a halogen atom; and X represents a divalent group selected from

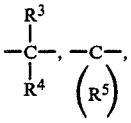

—O—, —S—, —SO—, and —$SO_2$—, wherein $R^3$ and $R^4$ each represents a hydrogen atom or an alkyl group; and $R^5$ represents an alkylene group.

14 Claims, No Drawings

HEAT TRANSFER RECORDING SHEET

FIELD OF THE INVENTION

This invention relates to a heat transfer recording sheet.

BACKGROUND OF THE INVENTION

A so-called sublimation type heat-sensitive transfer recording system comprises heating a transfer recording sheet having provided on one side thereof a coloring material layer formed by coating an ink containing a subliming dye and a binder, by a heating means, e.g., thermal head, and transferring the dye onto a recording sheet by sublimation. Binders which have conventionally been used for forming a coloring material layer are high-molecular compounds having a boiling point or softening point of 100° C. or higher. Particularly suitable binders include acrylic resins, methacrylic resins, polyvinylchloride, polyvinylidenechloride, polystyrene, polyvinylacetal, polyamide, polyvinyl alcohol, polycarbonate, polysulfone, polyethersulfone, cellulose resins, and the like as described in Japanese Patent Application (OPI) No. 14994/84 (the term "OPI" herein used means "unexamined published application").

With the recent tendency toward rapid recording, there has been a demand for heating the transfer recording sheet at higher temperatures. In order to meet this requirement, binders to be used in the transfer recording sheet have been demanded to have further improved heat resistance.

However, since the above-described resins, such as acrylic resins, methacrylic resins, polyvinyl chloride, polyvinylidenechloride polystyrene, etc. are softened or melted to cause adhesion to a recording sheet because of the lack of heat resistance, it has been difficult to obtain satisfactory recording.

Further, binders to be used in the transfer recording sheet should be dissolved in solvents or water in preparation of an ink. However, resins, such as polyamide, polycarbonate, polysulfone, polyethersulfone, etc. have low solubility so that the employable solvents are limited to halogen type solvents, which require much care in handling for safety and hygiene considerations.

In addition, binders to be used in the transfer recording sheet are generally required to have satisfactory compatibility with subliming dyes used. If the binder has poor compatibility with the dye, the dye dissolved in an ink and coated on a base film is crystallized during drying. Such being the case, the dye in non-recorded areas is also transferred to non-recorded areas in contact with a recording sheet to cause background stains, resulting in reduction of recording quality. On this account, polyvinyl alcohol, cellulose resins, etc. do not exhibit satisfactory compatibility with nonionic dyes which are commonly employed as subliming dyes and are, therefore, unfavorable as binders for transfer recording sheets.

SUMMARY OF THE INVENTION

Accordingly, an object of this invention is to provide a heat transfer recording sheet which does not undergo adhesion with a transfer sheet upon transfer recording.

Another object of this invention is to provide a heat transfer recording sheet, in which an ink composition can be prepared without using halogen type solvents.

A further object of this invention is to provide a heat transfer recording sheet, in which a subliming dye is not crystallized on the sheet during drying.

As a result of extensive investigations, it has now been found that the above objects can be accomplished by using a polycarbonate resin having a hereinafter described repeating unit as a binder for a coloring material layer.

According to one embodiment of the present invention, there is to provide a heat transfer recording sheet comprising a base film having provided on one side thereof a coloring material layer containing at least a subliming dye and a binder, wherein said binder is a polycarbonate resin having a repeating unit represented by the formula (I):

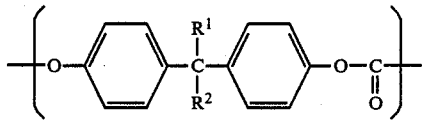

(I)

wherein $R^1$ represents an aryl group; and $R^2$ represents a hydrogen atom, an alkyl group or an aryl group.

According to another embodiment of the present invention, there is to provide a heat transfer recording sheet comprising a base film having provided on one side thereof a coloring material layer containing at least a subliming dye and a binder, wherein said binder is a copolymer of a polycarbonate resin having a repeating unit represented by the formula (I):

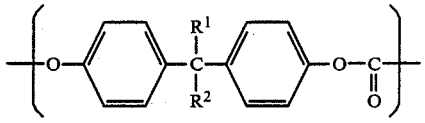

(I)

wherein $R^1$, and $R^2$ are defined above, and a repeating unit represented by the formula (II):

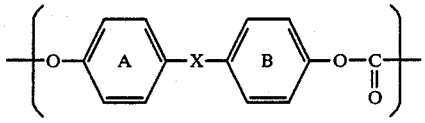

(II)

wherein rings A and B each represents a phenylene group or a phenylene group substituted with an alkyl group or a halogen atom; and X represents a divalent group selected from

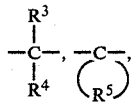

—O—, —S—, —SO—, and —$SO_2$—, wherein $R^3$ and $R^4$ each represents a hydrogen atom or an alkyl group; and $R^5$ represents an alkylene group.

DETAILED DESCRIPTION OF THE INVENTION

The polycarbonate resin which can be used in the present invention can be obtained by reacting at least one phenol compound represented by the formula (III):

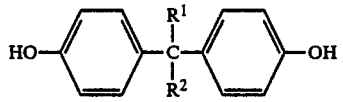

(III)

wherein $R^1$ and $R^2$ are as defined above, a combination of the phenol compounds or compounds of the formula (III) and at least one phenol compound represented by the formula (IV):

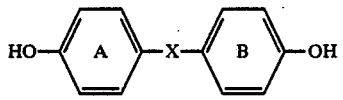

(IV)

wherein rings A and B and X are as defined above, with phosgene in a known manner.

The phenol compounds represented by the above formulae (III) and (IV) are used in an amount of not less than 30 weight percent and not more than 99 weight percent, and in an amount of more than 1 weight percent and less than 70 weight persent, respectively.

In the formulae (I) and (III), the aryl group as represented by $R^1$ or $R^2$ includes a phenyl group, etc., and the alkyl group as represented by $R^2$ includes a lower alkyl group having from 1 to 4 carbon atoms.

Specific examples of the phenol compounds represented by the formula (III) include bis(4-hyroxyphenyl)diphenylmethane, bis(4-hydroxyphenyl)-phenylmethane, 1,1-bis(4-hydroxyphenyl)-1-phenylethane, 1,1-bis(4-hydroxyphenyl)-1-phenylpropane, 1,1-bis(4-hydroxyphenyl)-1-phenylbutane, etc.

In the formulae (II) and (IV), the alkyl group as represented by $R^3$ or $R^4$ includes a lower alkyl group having from 1 or 2 carbon atoms, and the alkylene group as represented by $R^5$ includes an alkylene group having from 5 or 6 carbon atoms. In the substituted phenylene group as represented by ring A or B, the carbon atom or atoms at the orthoposition or positions with respect to the carbon atom connecting to the hydroxyl group is or are substituted with one or two methyl groups or one or two bromine atoms.

Specific examples of the phenol compounds represented by the formula (IV) include bis(hydroxyaryl)alkanes, e.g., bis(4-hydroxyphenyl)methane, 1,1-bis(4-hydroxyphenyl)ethane, 2,2-bis(4-hydroxyphenyl)propane, 2,2-bis(4-hydroxyphenyl)butane, 2,2-bis(4-hydroxy-3-methylphenyl)propane, 2,2-bis(4-hydroxy-3,5-dimethylphenyl)propane, 2,2-bis(4-hydroxy-3,5-dibromophenyl)propane, etc.; bis(hydroxyaryl)cycloalkanes, e.g., 1,1-bis(4-hydroxyphenyl)cyclopentane, 1,1-bis(4-hydroxyphenyl)cyclohexane, etc.; dihydroxydiaryl ethers, e.g., 4,4'-dihydroxydiphenyl ether, 4,4'-dihydroxy-3,3'-dimethyldiphenyl ether, etc.; dihydroxydiaryl sulfides, e.g., 4,4'-dihydroxydiphenyl sulfide, 4,4'-dihydroxy-3,3'-dimethyldiphenyl sulfide, etc.; dihydroxydiaryl sulfoxides, e.g., 4,4'-dihydroxydiphenyl sulfoxide, 4,4'-dihydroxy-3,3'-dimethyldiphenyl sulfoxide, etc.; and dihydroxydiaryl sulfones, e.g., 4,4'-dihydroxydiphenyl sulfone, 4,4'-dihydroxy-3,3'-dimethyldiphenyl sulfone, etc.

The polycarbonate resin according to the present invention has a reduced viscosity ($\eta sp/C$, wherein $\eta sp$ means specific viscosity; C means concentration of high molecule) ranging from 0.22 to 1.50 as measured in a 0.6 g/dl methylene chloride solution at 20° C. and a glass transition temperature (Tg) ranging from 160° to 230° C.

The heat transfer recording sheet according to the present invention can be prepared by dissolving the above-described polycarbonate resin and a subliming dye in an appropriate solvent to prepare an ink composition and coating the composition on a base film, followed by drying.

The subliming dye which can be used includes nonionic dyes, such as azo dyes, anthraquinone dyes, azomethine dyes, methine dyes, indoaniline dyes, naphthoquinone dyes, quinophthalone dyes, nitro dyes, and the like.

If desired, the ink composition can further contain, in addition to the polycarbonate resin and subliming dye, organic or inorganic fine particles, dispersing agents, antistatics, anti-blocking agents, defoaming agents, antioxidants, viscosity-controlling agents, and so on.

Solvents which can be used in the preparation of ink compositions include dioxane, toluene, tetrahydrofuran, chlorobenzene, o-dichlorobenzene, chloroform, methylene chloride, trichloroethylene, etc. Of these, nonhalogen type solvents are preferred from the standpoint of safety and hygiene.

The polycarbonate resin is used in the ink composition in concentrations of from 2 to 50% by weight, and preferably from 5 to 30% by weight. The subliming dye is used in the ink composition in concentrations of from 1 to 30% by weight, and preferably from 2.5 to 20% by weight.

Base films on which the ink composition can be coated include thin paper, such as condenser paper, glassine paper, etc.; and heat-resistant plastic films, such as polyamide, polyimide, cellophane, polyester, etc.

In order to improve thermal head running properties, a back side of the base film opposite to the coloring material layer may be coated, if desired, with a heat-resistant protective layer comprising a heat-resistant resin as disclosed in Japanese Patent Application (OPI) No. 7467/80; an anti-stick layer comprising a highly lubricating inorganic pigment and a thermosetting or high-softening resinous material as disclosed in Japanese Patent Application (OPI) No. 155794/81; or an abrasion-resistant and heat-resistant protective layer comprising a silicon oxide layer or a three-dimentional crosslinked layer of a polyfunctional (meth)acrylate compounds as disclosed in Japanese Patent Application (OPI) No. 7419/82.

For the purpose of improving adhesion to the ink composition, preventing color migration of the dye to the base film or ensuring thermal conduction from the base film to the coloring material layer, the side of the base film on which a coloring material layer is to be provided may be treated with water-soluble polyester resins, cellulose resins, polyvinyl alcohol, urethane resins, polyvinylidene chloride, etc., or may be provided with a thin aluminum layer.

The thickness of the base film suitably ranges from 3 to 25 μm.

Coating of the ink composition on the base film can be carried out by means of a gravure coater, a reverse-roll coater, a wire bar coater, an air doctor coater, etc. as described, e.g., in Y. Harazaki, *Coating Method*, Kozue Shoten (1979). The ink composition is coated to a wet thickness of from 0.1 to 50 μm and a dry thickness of from 0.01 to 5 μm.

Recording on the heat transfer recording sheet according to the present invention can be effected by intimately contacting the coloring material layer of the heat transfer recording sheet with a recording sheet and heating the coloring material layer from its back side by means of, for example, a thermal head which generates heat on electric signals according to image informations. Infrared rays, laser beams, etc. may also be used as a heating means.

This invention will now be illustrated in greater detail with reference to the following examples, but it should be understood that they are not intended to limit the present invention.

EXAMPLE 1

(a) Preparation of Ink Composition:

A phenol compound shown in Table 1 below and phosgene were reacted in a usual manner to prepare polycarbonate resins of the present invention. The reduced viscosity ($\eta sp/C$) and glass transition temperature (Tg) of the resulting polycarbonate resins are shown in Table 1.

TABLE 1

| Polycarbonate Resin No. | Phenol Compound | $\eta sp/C$ | Tg (°C.) |
|---|---|---|---|
| 1 | 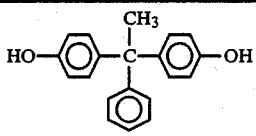 | 0.55 | 192 |
| 2 | 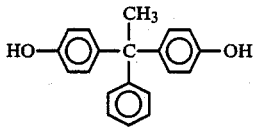 | 0.31 | 182 |
| 3 | 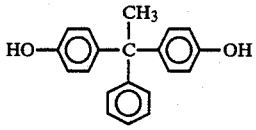 and 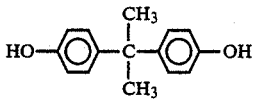 mixing ratio = 8:2 by weight | 0.34 | 178 |
| 4 | 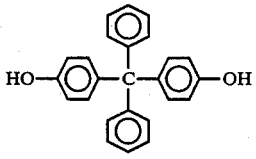 and 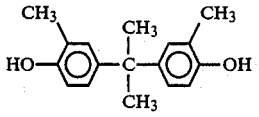 mixing ratio = 7:3 by weight | 0.31 | 202 |

TABLE 1-continued

| Polycarbonate Resin No. | Phenol Compound | $\eta sp/C$ | Tg (°C.) |
|---|---|---|---|
| 5 | 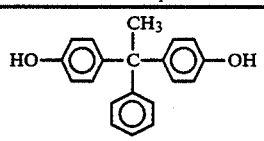 | 1.20 | 195 |

In Table 1, the difference in $\eta sp/C$ and Tg among Polycarbonate Resin Nos. 1, 2 and 5 (the phenol compound used being the same) is attributable to a difference in degree of polymerization.

Ten parts by weight of each of Resin Nos. 1 to 5 and 6 parts by weight of a subliming dye of the following formula (V) were dissolved in 84 parts by weight of toluene, dioxane or tetrahydrofuran. In each case, a uniform ink composition in which the polycarbonate resin and the dye were completely dissolved was obtained.

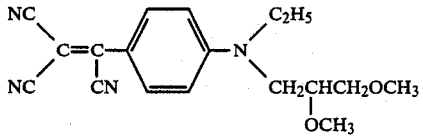

(V)

(b) Preparation of Heat Transfer Recording Sheet:

Each of the above-prepared ink compositions was coated to a wet thickness of 6 μm by means of a wire bar on a biaxially stretched polyethylene terephthalate film having a thickness of 6 μm with its back side (i.e., opposite to the side on which the ink composition was to be coated) having been treated with a polyimide resin to impart heat resistance and then dried to obtain a heat transfer recording sheet. In each case, the dye in the ink composition did not crystalize during or after the drying, and a completely transparent and uniform recording sheet having a magenta color could be obtained.

(c) Transfer Recording Test:

Each of the above-prepared heat transfer recording sheets was brought into contact with a transfer sheet having provided thereon a color developing layer containing a polyester resin and silica fine particles. Recording was carried out by applying an electric power of 0.2 W/dot for 1 to 10 milliseconds by means of a thermal head having a resistance heating element density of 8 dot/mm. As a result, there was observed neither adhesion between the recording sheet and the transfer sheet nor migration of the binder in the recording sheet to the transfer sheet in each case. After the recording, the recording sheet and the transfer sheet were easily peeled apart from each other.

The resulting image on each transfer sheet showed a satisfactory dot resolving power, a distinct magenta color and satisfactory gradation in conformity with the recording time.

Color densities of recorded images obtained by using transfer recording sheets in which toluene was used as a solvent were measured by the use of a Macbeth densitometer (TR-927) and Wratten Filter No. 58. The results obtained are shown in Table 2 below. It can be seen from Table 2 that images having satisfactory gradation and color densities sufficient for practical use could be obtained with a practically applicable energy.

TABLE 2

| Recording Time (milli-sec.) | Polycarbonate Resin No. 1 | 2 | 3 | 4 | 5 |
|---|---|---|---|---|---|
| 1 | 0.02 | 0.02 | 0.02 | 0.01 | 0.02 |
| 2 | 0.02 | 0.02 | 0.02 | 0.01 | 0.02 |
| 3 | 0.12 | 0.14 | 0.13 | 0.10 | 0.13 |
| 4 | 0.33 | 0.36 | 0.35 | 0.30 | 0.35 |
| 5 | 0.60 | 0.65 | 0.63 | 0.58 | 0.64 |
| 6 | 0.85 | 0.95 | 0.90 | 0.80 | 0.92 |
| 7 | 1.10 | 1.18 | 1.15 | 1.05 | 1.17 |
| 8 | 1.32 | 1.40 | 1.38 | 1.30 | 1.39 |
| 9 | 1.50 | 1.59 | 1.55 | 1.48 | 1.58 |
| 10 | 1.52 | 1.62 | 1.59 | 1.52 | 1.61 |

EXAMPLE 2

In the same manner as described in Example 1 but using a cyan dye represented by the following formula (VI) substituted for the dye of the formula (V), ink compositions were prepared and heat transfer recording sheets were obtained using the resulting compositions.

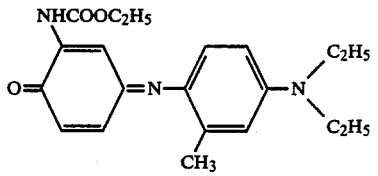

(VI)

In the preparation of ink compositions, the cyan dye and each of the polycarbonate resins were completely dissolved to give a uniform cyan ink composition. Each of the resulting cyan-colored heat transfer recording sheets was transparent, uniform and free from crystallization of the dye on the sheet.

When these recording sheets were subjected to the same recording test as in Example 1, an image of a distinct cyan color having satisfactory gradation could be obtained without being accompanied by adhesion between the recording sheet and the transfer sheet in each case.

Color densities of recorded images obtained by using transfer recording sheets in which toluene was used as a solvent were measured in the same manner as in Example 1 but using Wratten Filter No. 25. The results obtained are shown in Table 3 below.

TABLE 3

| Recording Time (milli-sec.) | Polycarbonate Resin No. 1 | 2 | 3 | 4 | 5 |
|---|---|---|---|---|---|
| 1 | 0.02 | 0.03 | 0.03 | 0.02 | 0.02 |
| 2 | 0.03 | 0.03 | 0.03 | 0.02 | 0.03 |
| 3 | 0.10 | 0.12 | 0.11 | 0.10 | 0.11 |
| 4 | 0.30 | 0.35 | 0.32 | 0.28 | 0.34 |
| 5 | 0.55 | 0.60 | 0.58 | 0.52 | 0.57 |
| 6 | 0.80 | 0.85 | 0.83 | 0.79 | 0.83 |
| 7 | 1.05 | 1.14 | 1.10 | 1.01 | 1.10 |
| 8 | 1.32 | 1.40 | 1.37 | 1.30 | 1.38 |
| 9 | 1.50 | 1.59 | 1.55 | 1.48 | 1.57 |
| 10 | 1.60 | 1.72 | 1.69 | 1.55 | 1.70 |

EXAMPLE 3

In the same manner as described in Example 1 but using a yellow dye of the following formula (VII) substituted for the dye of the cormula (VI), ink compositions were prepred and heat transfer recording sheets were obtained using the resulting ink compositions.

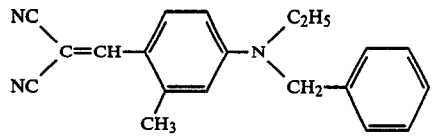

(VII)

The yellow dye and each of the polycarbonate resins were completely dissolved to give a uniform yellow ink composition. Each of the resulting yellow-colored heat transfer recording sheets was transparent, uniform and free from crystallization of the dye on the sheet.

When these recording sheets were subjected to the same recording test as in Example 1, an image of a distinct yellow color having satisfactory gradation could be obtained without being accompanied by adhesion between the recording sheet and the transfer sheet in each case.

Color densities of recorded images obtained by using transfer recording sheets in which toluene was used as a solvent were measured in the same manner as in Example 1 but using Wratten Filter No. 47. The results obtained are shown in Table 4.

TABLE 4

| Recording Time (milli-sec.) | Polycarbonate Resin No. 1 | 2 | 3 | 4 | 5 |
|---|---|---|---|---|---|
| 1 | 0.01 | 0.01 | 0.01 | 0.01 | 0.01 |
| 2 | 0.01 | 0.02 | 0.01 | 0.01 | 0.02 |
| 3 | 0.09 | 0.12 | 0.11 | 0.09 | 0.11 |
| 4 | 0.24 | 0.28 | 0.26 | 0.24 | 0.26 |
| 5 | 0.38 | 0.43 | 0.40 | 0.36 | 0.41 |
| 6 | 0.54 | 0.59 | 0.56 | 0.52 | 0.57 |
| 7 | 0.65 | 0.72 | 0.68 | 0.63 | 0.70 |
| 8 | 0.69 | 0.76 | 0.72 | 0.67 | 0.74 |
| 9 | 0.76 | 0.83 | 0.79 | 0.74 | 0.81 |
| 10 | 0.80 | 0.86 | 0.83 | 0.78 | 0.85 |

COMPARATIVE EXAMPLE 1

The same ink composition as described in Example 1 was prepared in the same manner as described in Example 1 but replacing the polycarbonate resin as used in Example 1 with a resin shown in Table 5 below and using toluene, dioxane, tetrahydrofuran, methyl ethyl ketone, ethyl acetate, cellosolve or water as a solvent.

However, Resin Nos. 1 to 4 were not completely dissolved in any of these solvents, resulting in the failure of obtaining uniform ink compositions.

With Resin Nos. 5 to 10, uniform ink compositions in which each of the resins and the dye were completely dissolved in each of the solvents were obtained. However, when each of these compositions was coated on a base film and dried, crystals of the dye were precipitated on the sheet, failing to obtain a uniform heat transfer recording sheets. When the resulting transfer recording sheet was subjected to transfer test in the same manner as in Example 1, background stains were observed in every case. In particular, when the recording time was extended, the transfer recording sheet using Resin No. 5, 6 or 7 underwent adhesion to a transfer sheet so that recording could not be performed satisfactorily.

TABLE 5

| Resin No. | Type of Resin | Trade Name | Maker |
|---|---|---|---|
| 1 | polycarbonate | Iupilon S-2000 | Mitsubishi Gas Chemical Ind., Ltd. |
| 2 | polysulfone | Udel Polysulfone P8000 | Nissan Chemicals Ind., Ltd. |
| 3 | polyether sulfone | Victolex PES 430P | Mitsui Toatsu Chemicals Inc. |
| 4 | polyamide | Amiran CM1071 | Toray Industries, Inc. |
| 5 | acrylic resin | Acrypet MD | Mitsubishi Rayon Co., Ltd. |
| 6 | polystyrene | Dialex HF-77 | Mitsubishi Monsanto Chemical Co., Ltd. |
| 7 | polyvinyl chloride | Vinica PVC 37L | Mitsubishi Monsanto Chemical Co., Ltd. |
| 8 | cellulose acetate | L-30 | Daisel Ltd. |
| 9 | ethyl cellulose | N-7 | Hercules |
| 10 | polyvinyl alcohol | Gosenol NL-05 | Nippon Synthetic Chemical Ind. Co., Ltd. |

The polycarbonate resins according to the present invention exhibit excellent heat resistance as having a glass transition temperature between 160° C. and 230° C. Therefore, when they are applied to heat transfer recording sheets as a binder, they are not softened or melted and do not cause adhesion between the recording sheet and a transfer sheet upon heating for recording, thereby to obtain high quality images.

Further, since the polycarbonate resins of the present invention exhibit excellent solubility in organic solvents including non-halogen type solvents, such as toluene, dioxane, tetrahydrofuran, etc., ink compositions can be prepared by using these non-halogen type solvents, thus excluding safety and hygiene problems on handling of inks.

Furthermore, since the polycarbonate resins of this invention are excellent in compatibility with nonionic subliming dyes to be used in combination in a coloring material layer, crystallization of the dye in the layer does not occur after drying.

While the invention has been described in detail and with reference to specific embodiments thereof, it will be apparent to one skilled in the art that various changes and modifications can be made therein without departing from the spirit and scope thereof.

What is claimed is:

1. A heat transfer recording sheet comprising a base film having provided on one side thereof a coloring material layer containing at least a subliming dye and a binder, wherein said binder is a polycarbonate resin having a repeating unit represented by the formula (I):

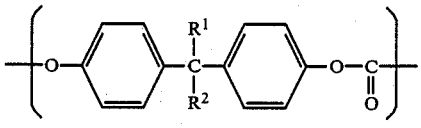

(I)

wherein $R^1$ represents an aryl group; and $R^2$ represents a hydrogen atom, an alkyl group or an aryl group.

2. A heat transfer recording sheet as in claim 1, wherein $R^1$ represents a phenyl group, and $R^2$ represents a hydrogen atom, a lower alkyl group or a phenyl group.

3. A heat transfer recording sheet as in claim 2, wherein said lower alkyl group is a methyl group, an ethyl group or a propyl group.

4. A heat transfer recording sheet as in claim 1, wherein $R^1$ represents a phenyl group, and $R^2$ represents a methyl group or a phenyl group.

5. A heat transfer recording sheet as in claim 1, wherein said polycarbonate resin has a reduced viscosity of from 0.22 to 1.50 as measured in a 0.6 g/dl methylene chloride solution at 20° C.

6. A heat transfer recording sheet as in claim 1, wherein said polycarbonate resin has a reduced viscosity of from 0.31 to 1.20 as measured in a 0.6 g/dl methylene chloride solution at 20° C.

7. A heat transfer recording sheet as in claim 1, wherein said subliming dye is a methine dye or an indoaniline dye.

8. A heat transfer recording sheet comprising a base film having provided on one side thereof a coloring material layer containing at least a subliming dye and a binder, wherein said binder is a copolymer of polycarbonate resin having a repeating unit represented by the formula (I):

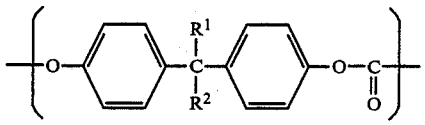

(I)

wherein $R^1$ represents an aryl group; and $R^2$ represents a hydrogen atom, an alkyl group or an aryl group, and repeating unit represented by the formula (II):

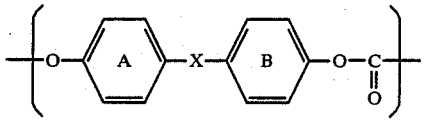

(II)

wherein rings A and B each represents a phenylene group or a phenylene group substituted with an alkyl group or a halogen atom; and X represents a divalent group selected from

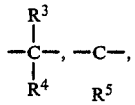

—O—, —S—, —SO—, and —$SO_2$—, wherein $R^3$ and $R^4$ each represents a hydrogen atom or an alkyl group; and $R^5$ represents an alkylene group, said repeating unit of the formula (I) being present in an amount of not less than 30 weight percent and not more than 99 weight percent, and said repeating unit of the formula (II) being present in an amount less than 70 weight percent.

9. A heat transfer recording sheet as in claim 1, wherein $R^1$ represents a phenyl group; $R^2$ represents a hydrogen atom, a lower alkyl group or a phenyl group; $R^3$ and $R^4$ each represents a hydrogen atom or an alkyl group having from 1 to 2 carbon atoms; and $R^5$ represents an alkylene group having from 5 to 6 carbon atoms.

10. A heat transfer recording sheet as in claim 1, wherein X is —$CH_2$—,

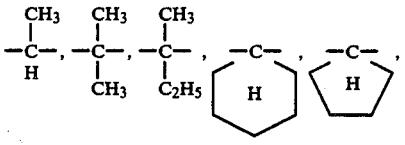

—O—, —S—, —SO— or —$SO_2$—.

11. A heat transfer recording sheet as in claim 1, wherein rings A and B each represents a phenylene group substituted with one or two methyl groups or one or two bromine atoms at the ortho-position or positions with respect to the carbon atom connecting to the oxygen atom derived from a hydroxyl group of starting bisphenol.

12. A heat transfer recording sheet as in claim 11, wherein the moiety of the formula

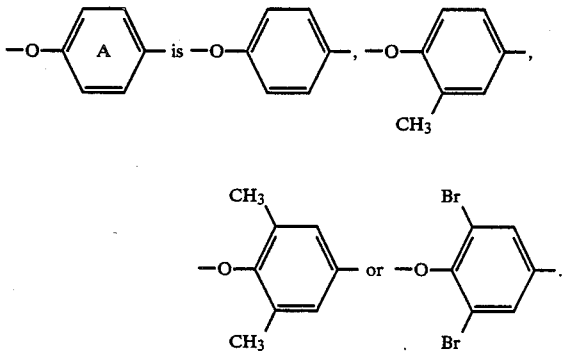

13. A heat transfer recording sheet as in claim 11, wherein the moiety of the formula

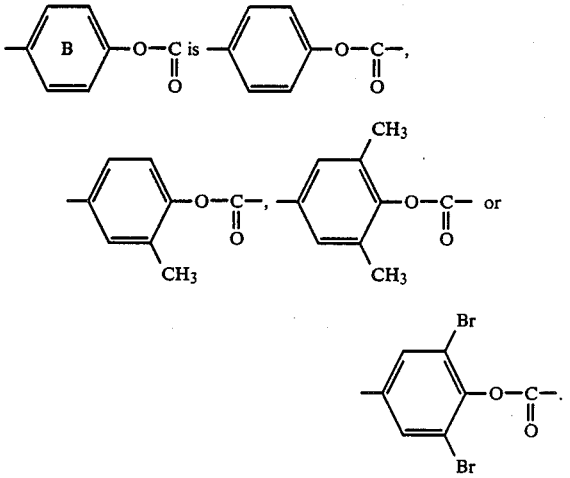

14. A heat transfer recording sheet as in claim 8, wherein $R^1$ represents a phenyl group; $R^2$ represents a methyl group or a phenyl group; X represents

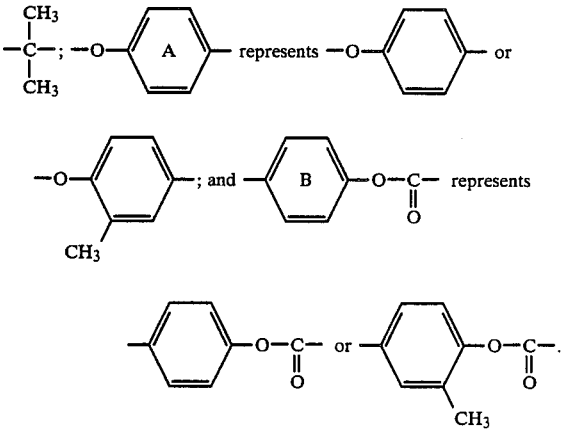

* * * * *

UNITED STATES PATENT AND TRADEMARK OFFICE

CERTIFICATE OF CORRECTION

PATENT NO. : 4,748,151

DATED : May 31, 1988

INVENTOR(S) : Murata, et al

It is certified that error appears in the above-identified patent and that said Letters Patent is hereby corrected as shown below:

| Col. | Line | |
|---|---|---|
| 10 | 50 | change $-\overset{R^3}{\underset{R^4}{C}}-$, $-\underset{(R^5)}{C}-$, to $-\overset{R^3}{\underset{R^4}{C}}-$, $\underset{R^5}{C}=$, |
| 10 | 60 (Claim 9) | change "1" to --8--. |
| 10 | 67 (Claim 10) | change "1" to --8--. |

Signed and Sealed this

Sixth Day of December, 1988

*Attest:*

*Attesting Officer*

DONALD J. QUIGG

*Commissioner of Patents and Trademarks*